US007704090B2

(12) United States Patent
Fumikura

(10) Patent No.: US 7,704,090 B2
(45) Date of Patent: Apr. 27, 2010

(54) HOUSING FOR A CARD EDGE CONNECTOR ASSEMBLY

(75) Inventor: Tadahiro Fumikura, Chiba (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/105,432

(22) Filed: Apr. 18, 2008

(65) Prior Publication Data

US 2008/0268688 A1 Oct. 30, 2008

(30) Foreign Application Priority Data

Apr. 27, 2007 (JP) ..... 2007-119362

(51) Int. Cl.
*H01R 13/62* (2006.01)

(52) U.S. Cl. ..... 439/326; 439/325; 361/748

(58) Field of Classification Search ..... 439/325–326, 439/541.5, 540.1, 61, 260, 328; 361/736, 361/748

See application file for complete search history.

(56) References Cited

U.S. PATENT DOCUMENTS 5,839,913 A * 11/1998 Fumikura ..... 439/326
6,027,357 A * 2/2000 Howell et al. ..... 439/326
6,077,098 A * 6/2000 Yu et al. ..... 439/326
6,126,472 A 10/2000 Choy
6,796,825 B2 * 9/2004 Wang ..... 439/326

FOREIGN PATENT DOCUMENTS

JP 2002-190354 5/2002

* cited by examiner

*Primary Examiner*—Edwin A. Leon
*Assistant Examiner*—Vanessa Girardi
(74) *Attorney, Agent, or Firm*—Barley Snyder LLC

(57) ABSTRACT

A card edge connector for electrically connects a mother board with a daughter board. The card edge connector includes an upper card edge connector with an insulating housing provided with a daughter board receiving recess. Latch arms extend from the insulating housing at both ends of the daughter board receiving recess. Each of the latch arms has a holding arm extending substantially parallel to a support arm. The holding arm is connected to the support arm by a folded portion. At least a portion of the support arm is divided into a first support section and a second support section. The first support section and the second support section each has an inclined portion extending diagonally away from the holding arm.

9 Claims, 8 Drawing Sheets

HOUSING FOR A CARD EDGE CONNECTOR ASSEMBLY

CROSS-REFERENCE TO RELATED APPLICATIONS

This application claims the benefit of the filing date under 35 U.S.C. §119(a)-(d) of Japanese Patent Application No. 2007-119362, filed Apr. 27, 2008.

FIELD OF THE INVENTION

The present invention relates to a card edge connector having an insulating housing that receives a daughter board wherein the insulating housing has latch arms for attaching the daughter board to the insulating housing.

BACKGROUND

Conventionally, there has been a known card edge connector which connects a daughter board such as a memory module to a printed circuit board as a mother board incorporated in equipment such as a personal computer. For example, Japanese Patent Application Publication No. 2002-190354 describes a card edge connector having an insulation housing mounted on a mother board and a pair of latch arms mounted on the housing which holds a daughter board. The latch arms are formed by stamping and bending a metal plate. The latch arms hold the daughter board utilizing its own elasticity.

In recent years, it has been known to connect a plurality of daughter boards to a mother board. For example, to increase the memory capacity of a personal computer, it is known to connect a plurality of memory modules to a mother board. On the other hand, in the case of equipment which is required to be reduced in size, it is desired to reduce the amount of space occupied by the memory module connected to the mother board.

For example, U.S. Pat. No. 6,126,472 describes a connector assembly including an edge connector having a resin latch arm which is integrally molded together with a housing. The connector assembly includes an upper card edge connector and a lower card edge connector. Both the upper card edge connector and the lower card edge connector include a housing which receives from a front thereof a dual inline memory module (DIMM) as a daughter board and passages that extend forward from both sides of the housing. The upper card edge connector is at a position lifted up by a lifting member, and the passages are superposed on the lower card edge connector and positioned rearward. Therefore, the DIMM received by the upper card edge connector is superposed on the lower card edge connector and the area occupied on the mother board is small.

FIGS. 1(*a*)-(*b*) show another conventional example of card edge connectors having metal latch arms wherein two daughter boards D1, D2 can be disposed such that they are superposed on each other. In FIGS. 1(*a*)-(*b*), the two card edge connectors can be used as one set or can be used independently from each other. As shown in FIGS. 1(*a*)-(*b*), the lower card edge connector 1 and the upper card edge connector 2 are mounted on a mother board M, and memory modules, as daughter boards D1, D2, both having the same shapes are attached to the lower card edge connector 1 and the upper card edge connector 2. In the following description, a side of the mother board M is defined as down D, its opposite side is defined as up U, a side where the daughter board D1, D2 is received is defined as front F, its opposite side is defined as back B, right moving forward from is defined as right R, and left side is defined as left L.

First, a structure which is common for the lower card edge connector 1 and the upper card edge connector 2 will be described collectively. The lower card edge connector 1 and the upper card edge connector 2 respectively include insulating housings 11, 21 that receive daughter boards D1, D2, a plurality of contacts 12, 22, a pair of latch arms 13, and a pair of latch arms 23. The insulating housings 11, 21 are provided with daughter board receiving recesses 111, 211 that receive the daughter boards D1, D2 from the front F. The contacts 12, 22 are disposed along a longitudinal direction of the daughter board receiving recesses 111, 211 (only a few of the contacts 12, 22 are shown). The latch arms 13, 23 project forward F from both left and right ends in the longitudinal direction of the insulating housings 11, 21, i.e., in the lateral direction. The latch arms 13, 23 are formed in a bilateral symmetrical manner wherein left and right structures thereof are in common.

The latch arms 13, 23 include holding arms 131, 231 which support the daughter boards D1, D2, support arms 133, 233 which support the holding arms 131, 231, folded portions 132, 232 folded back from the holding arms 131, 231, and press-fit sections 135, 235 which are press-fitted into the insulating housings 11, 21. Each of the latch arms 13, 23 is formed by stamping and bending one metal plate. That is, the holding arm 131, the support arm 133, the folded portion 132 and the press-fit section 135 are integrally formed together, and the holding arm 231, the support arm 233, the folded portion 232 and the press-fit section 235 are integrally formed together. The holding arms 131, 231 and the support arms 133, 233 are bifurcated through the folded portions 132, 232, and the press-fit sections 135, 235 located at root sides of the bifurcated portions are fixed to the insulating housings 11, 21.

The holding arms 131, 231 extend forward F, and the folded portions 132, 232 are folded back outward by about 180 degrees from upper edges of rear ends of the holding arms 131, 231. The support arms 133, 233 extend forward from the folded portions 132, 232. The fixed sections 134, 234 project from lower edges of the support arms 133, 233. Mother board attachment members 15, 25 soldered to the mother board M are mounted on the fixed sections 134, 234. The press-fit sections 135, 235 extend backward B from the support arms 133, 233. The holding arms 131, 231 are provided at tip ends with first locking members 131*a*, 231*a* which are engaged with notches formed in the daughter board D1, D2, and second locking members 131*b*, 231*b* which prevent the daughter board D1, D2 from floating up and coming out from the first locking members 131*a*, 231*a*.

The press-fit sections 135, 235 of the latch arms 13, 23 are press-fitted into the insulating housings 11, 21. The holding arms 131, 231 are supported by the insulating housings 11, 21 in a cantilever spring manner through the press-fit sections 135, 235 and the folded portions 132, 232. The holding arms 131, 231 themselves are elastically deformed so that tip ends thereof are displaced in the lateral direction LR. When the daughter boards D1, D2 are attached to the lower card edge connector 1 and the upper card edge connector 2, the holding arms 131, 231 are once elastically deformed outward by manual operation. After the edges of the daughter boards D1, D2 are received by the insulating housings 11, 21, the holding arms 131, 231 return inward and the holding arms 131, 231 sandwich the daughter boards D1, D2 from both end edges in the lateral direction LR by their elasticity. The first locking members 131*a*, 231*a* of the holding arms 131, 231 are engaged with edges of the daughter boards D1, D2.

The support arms 133, 233 are formed with inclined portions 133*a*, 233*a* which bend at positions in front of front edges of the folded portions. The inclined portions 133*a*, 233*a* are inclined forward and diagonally outward. The support arms 133, 233 are again bent at positions forward F of the inclined portions 133*a*, 233*a* and extend forward substantially in parallel to the holding arms 131, 231. A stopper 133*c* is provided on a tip end of the support arm 133 of the lower card edge connector 1 to prevent the holding arm 131 from being bent excessively. In addition, a pair of stoppers 233*b*, 233*c* is provided on a tip end of the support arm 233 of the upper card edge connector 2 to prevent the holding arm 231 from being bent excessively. The holding arm 231 is disposed between the stoppers 233*b*, 233*c*. Further, the fixed sections 134, 234 project from lower edges of tip ends of the support arms 133, 233. The fixed sections 134, 234 extend in the lateral direction LR. The mother board attachment members 15, 25 are arranged on the fixed sections 134, 234.

The lengths of the holding arms 131, 231 of the latch arms 13, 23 are determined in accordance with the size specifications of a daughter board D1, D2 to be attached. A force required for deforming the holding arms 131, 231 outward, and forces of the holding arms 131, 231 for pinching the daughter board D1, D2 are determined by the lengths of the folded portions 132, 232. Portions of the holding arms 131, 231 which are provided at their upper edges in the folded portions 132, 232 have higher rigidity as compared with other portions of the holding arms 131, 231 which do not have the folded portions 132, 232. The holding arms 131, 231 are in communication with the support arms 133, 233 to be fixed to the mother board M and the insulating housings 11, 21 through the press-fit sections 135, 235 and the fixed sections 134 and 234 by the folded portions 132, 232. As the lengths of the folded portions 132, 232 are longer, the rigidities of the entirety of the holding arms 131, 231 are higher. The lengths of the folded portions 132, 232 of the lower card edge connector 1 and the upper card edge connector 2 shown in FIG. 1 are adjusted to such a level that the holding arms 131, 231 can appropriately be bent outward with finger's force and the daughter board D1, D2 is pinched between the holding arms 131, 231 with such a force that the daughter board D1, D2 is not pulled out.

Next, a difference between the lower card edge connector 1 and the upper card edge connector 2 will be described. The height of the insulating housing 21 of the upper card edge connector 2 is about two times of that of the insulating housing 11 of the lower card edge connector 1. The daughter board receiving recess 211 is formed at a position twice as high as the daughter board receiving recess 111 of the lower card edge connector 1 as measured from the mother board M. The holding arm 231 of the upper card edge connector 2 is disposed at the same height as the daughter board receiving recess 211.

As shown in FIG. 3, the support arm 233 of the upper card edge connector 2 is about two times as high as the support arm 133 of the lower card edge connector 1 in accordance with the height of the insulating housing 21. The fixed section 134 of the lower card edge connector 1 is bent inward, but the fixed section 234 of the upper card edge connector 2 is bent outward. Therefore, the lower card edge connector 1 can be disposed between the pair of the latch arms 23 in front of the inclined portion 233*a* of the upper card edge connector 2.

As shown in FIG. 4, the lower card edge connector 1 and the upper card edge connector 2 are mounted on a surface of the mother board M by soldering. The insulating housing 11 of the lower card edge connector 1 is disposed between the pair of the latch arms 23 of the upper card edge connector 2 on the mother board M. The latch arms 13 and the latch arms 23 are press fitted in both ends of the insulating housings 11, 21 in the lateral direction LR, and the insulating housing 21 of the upper card edge connector 2 has the same length as that of the insulating housing 11 of the lower card edge connector 1 in the lateral direction LR. The insulating housing 11 of the lower card edge connector 1 is disposed in front of the inclined portion 233*a* formed on the latch arm 23.

In a state where the daughter boards D1, D2 are mounted on the lower card edge connector 1 and the upper card edge connector 2, the insulating housing 11 of the lower card edge connector 1 and a portion of the daughter board D1 mounted on the lower card edge connector 1 are superposed on the daughter board D2 mounted on the upper card edge connector 2, as viewed from above. Therefore, according to the lower card edge connector 1 and the upper card edge connector 2 shown in FIG. 4, the occupied area on the mother board M is reduced by the superposed portion as compared with a case in which the daughter board D1, D2 and the lower card edge connector 1 and the upper card edge connector 2 are not superposed on each other and the mother board M can be utilized effectively.

In recent years, as can be seen in notebook personal computer, it is required that an area of a mother board M occupied by a part is further reduced as the equipment is reduced in size and the performance thereof becomes high. In a connector to which the daughter board is attached, it is also required to increase an area of superposed portion and to reduce an area occupied by the connector. In the lower card edge connector 1 and the upper card edge connector 2 shown in FIG. 4, if a disposition distance W1 between the lower card edge connector 1 and the upper card edge connector 2 is reduced, the area of the superposed portion is increased. As a method for reducing the disposition distance W1 between the lower card edge connector 1 and the upper card edge connector 2, it is conceivable to shorten the length of the folded portion 232 in the upper card edge connector 2, and to form the inclined portion 233*a* rearward B as compared with the position shown in FIG. 4, i.e., closer to the insulating housing 21.

However, if the length of the folded portion 232 is changed, the rigidity of the holding arm 231 is changed. That is, if the folded portion 232 is shortened, there is an adverse possibility that the folded portion 232 can not hold the daughter board D1, D2. In addition, the folded portion 232 connects the holding arm 231 and the support arm 233 to each other. Thus, if the length of the folded portion 232 is shortened, there is a possibility that the folded portion 232 is damaged when an excessive force is applied to the holding arm 231 or when a force is repeatedly applied.

SUMMARY

The present invention has been made in view of the above circumstances and provides a card edge connector capable of reducing an occupied area on a mother board while suppressing deterioration in rigidity of a latch arm and damage thereof.

This and other objects are achieved by a card edge connector for electrically connecting a mother board with a daughter board wherein the card edge connector comprises an upper card edge connector with an insulating housing provided with a daughter board receiving recess. Latch arms extend from the insulating housing at both ends of the daughter board receiving recess. Each of the latch arms has a holding arm extending substantially parallel to a support arm. The holding arm is connected to the support arm by a folded portion. At least a portion of the support arm is divided into a first support section and a second support section. The first support section and the second support section each has an inclined portion extending diagonally away from the holding arm.

BRIEF DESCRIPTION OF THE DRAWINGS

FIG. 1(*b*) is a right side view of the upper card edge connector and the lower card edge connector shown in FIG. 1(*a*);

FIG. 4(*b*) is a right side view of the upper card edge connector and the lower card edge connector shown in FIG. 4(*a*) mounted on daughter boards;

FIG. 5(*b*) is a right side view of the upper card edge connector and the lower card edge connector shown in FIG. 5(*a*);

FIG. 7(*b*) is a right side view of the upper card edge connector and the lower card edge connector shown in FIG. 7(*a*) mounted on daughter boards;

FIG. 8(*b*) is a schematic diagram showing the disposition distance between the lower card edge connector and the upper card edge connector.

DETAILED DESCRIPTION OF THE EMBODIMENT(S)

Figures 1A, 1B:
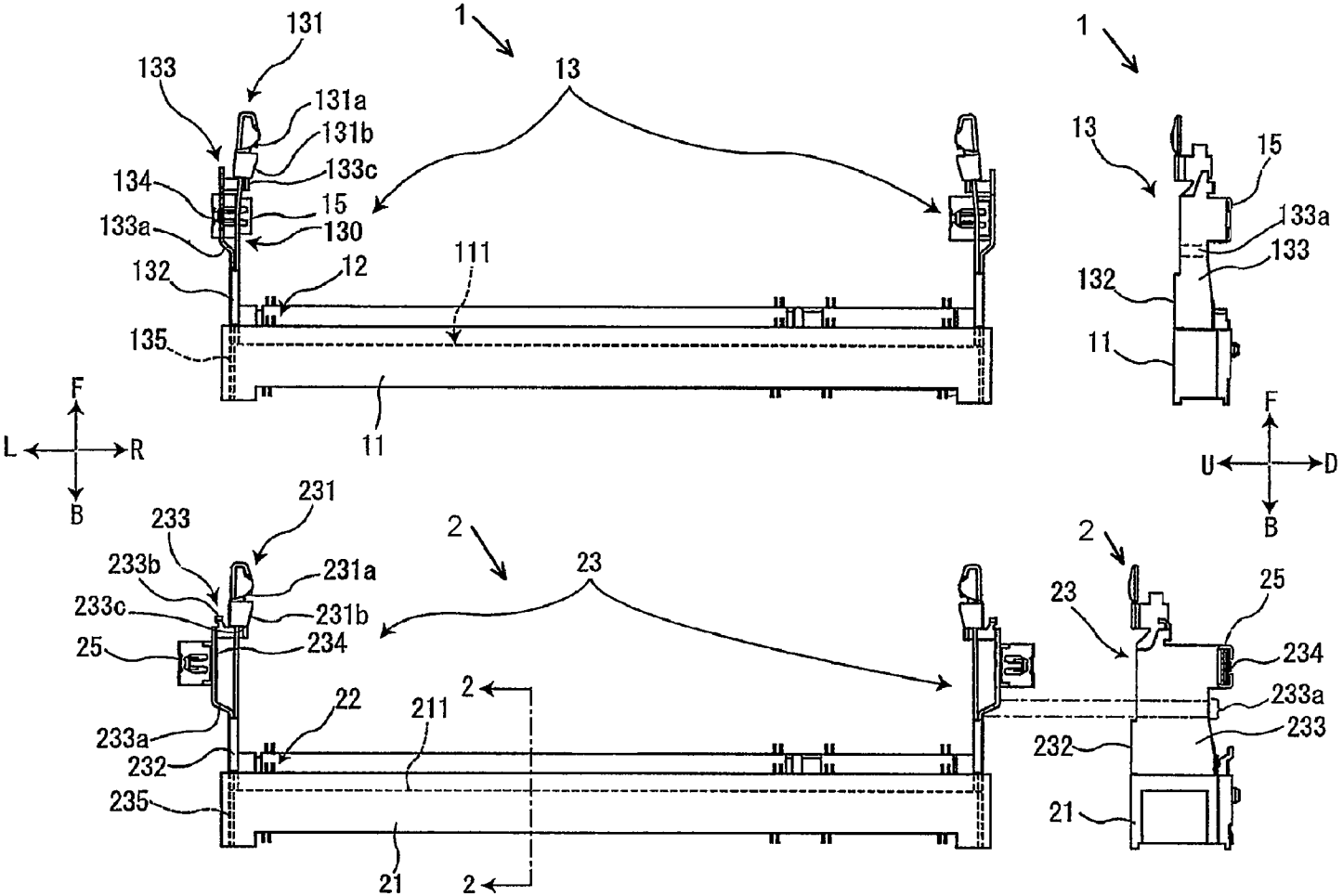
Fig. 1(b) PRIOR ART
Fig. 1(a) PRIOR ART
FIG. 1(*a*) is a plan view of an upper card edge connector and a lower card edge connector according to the prior art.
Figure 2:
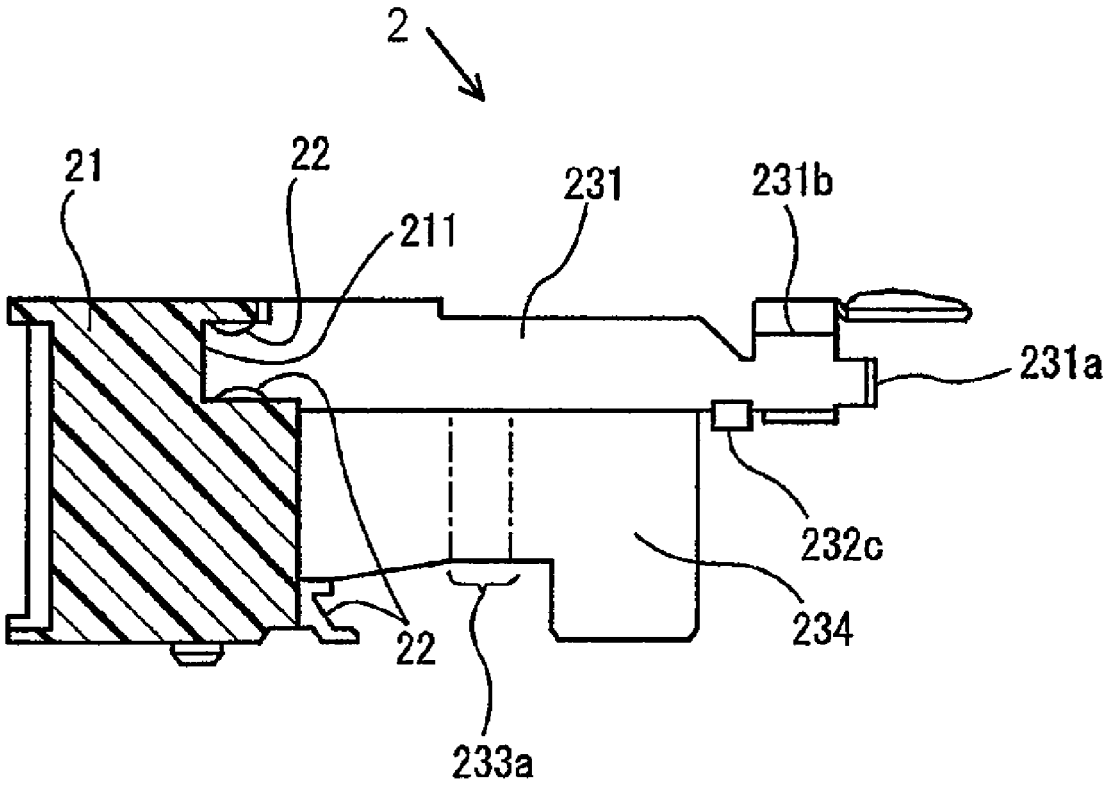
Fig. 2 PRIOR ART
FIG. 2 is a partial sectional view along line 2-2 in FIG. 1(*a*)
Figure 3:
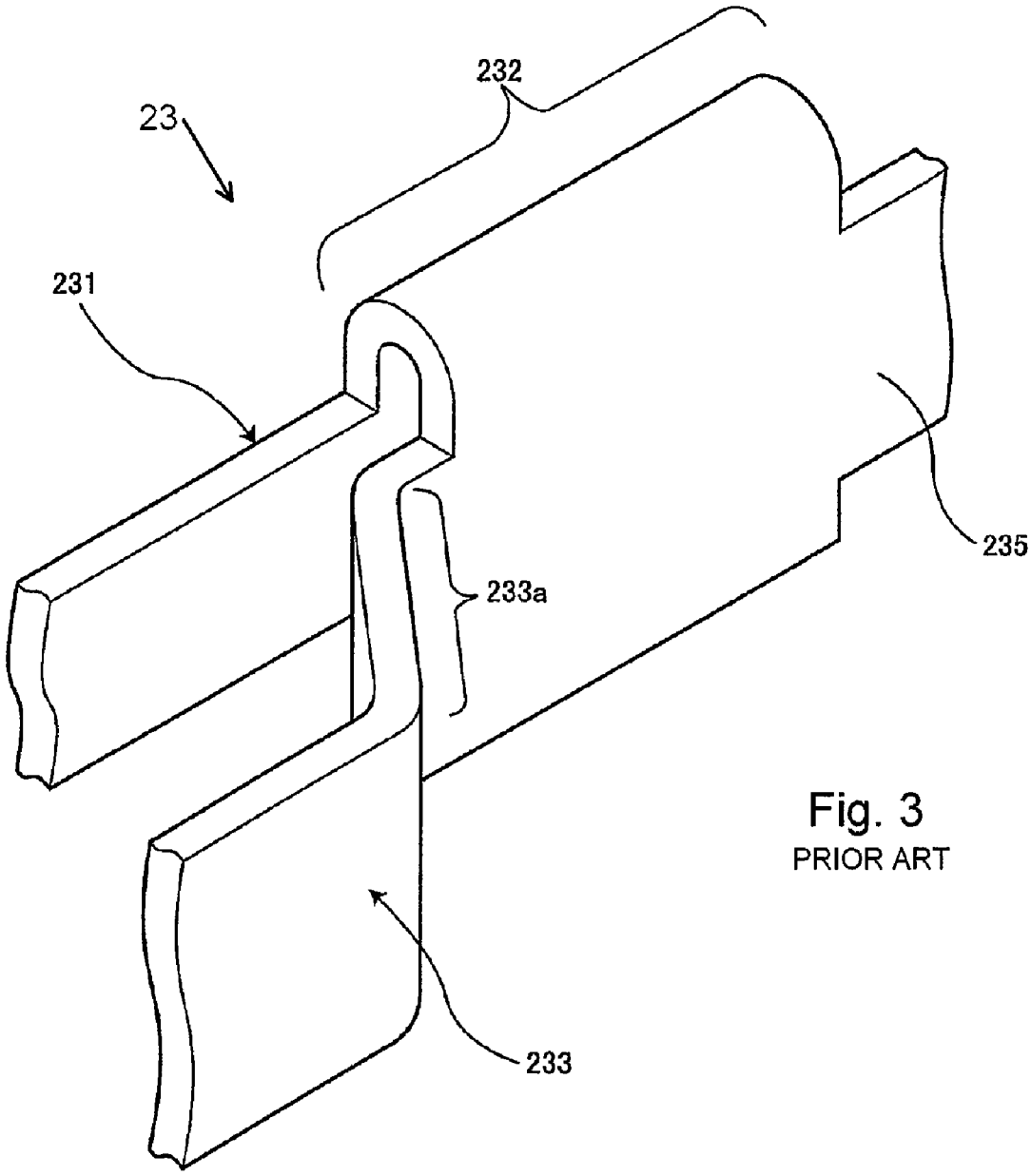
Fig. 3 PRIOR ART
FIG. 3 is a front perspective view of a portion of a latch arm of the upper card edge connector shown in FIG. 1.
Figures 5A, 5B:
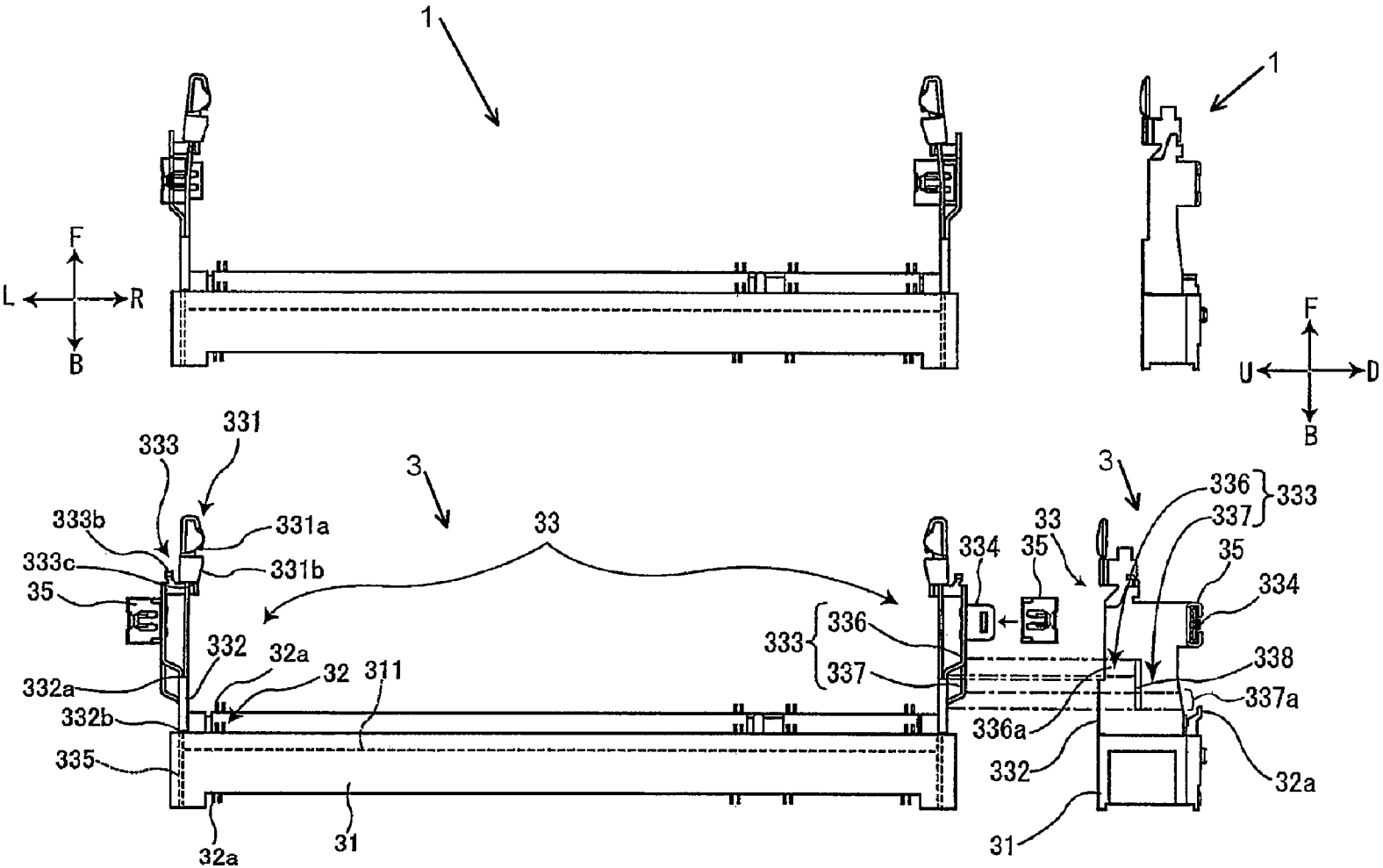
FIG. 5(*a*) is a plan view of an upper card edge connector and a lower card edge connector according to an embodiment of the present invention.

FIGS. 5(*a*)-(*b*) show a card edge connector according to an embodiment of the invention. The card edge connector includes a lower card edge connector 1 and an upper card edge connector 3. The upper card edge connector 3 can also be used independently from the lower card edge connector 1. Because the lower card edge connector 1 has already been explained with reference to FIGS. 1(*a*)-(*b*), further description thereof will not be provided hereafter except when necessary to describe the relationship of the lower card edge connector 1 with the upper card edge connector 3.

Figures 7A, 7B:
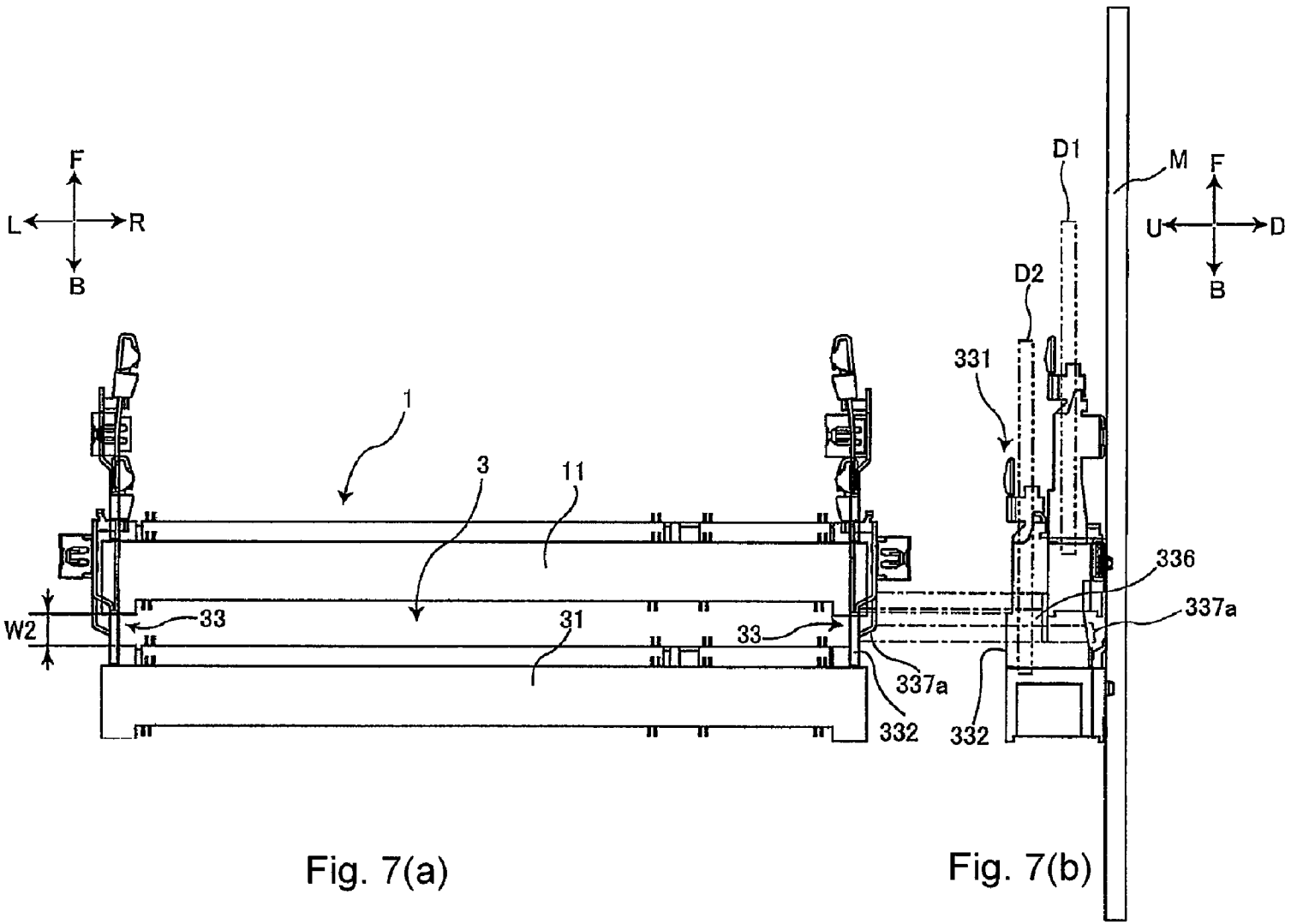
FIG. 7(*a*) is a plan view of the upper card edge connector and the lower card edge connector shown in FIG. 5(*a*) mounted on a mother board.
Figures 8A, 8B:
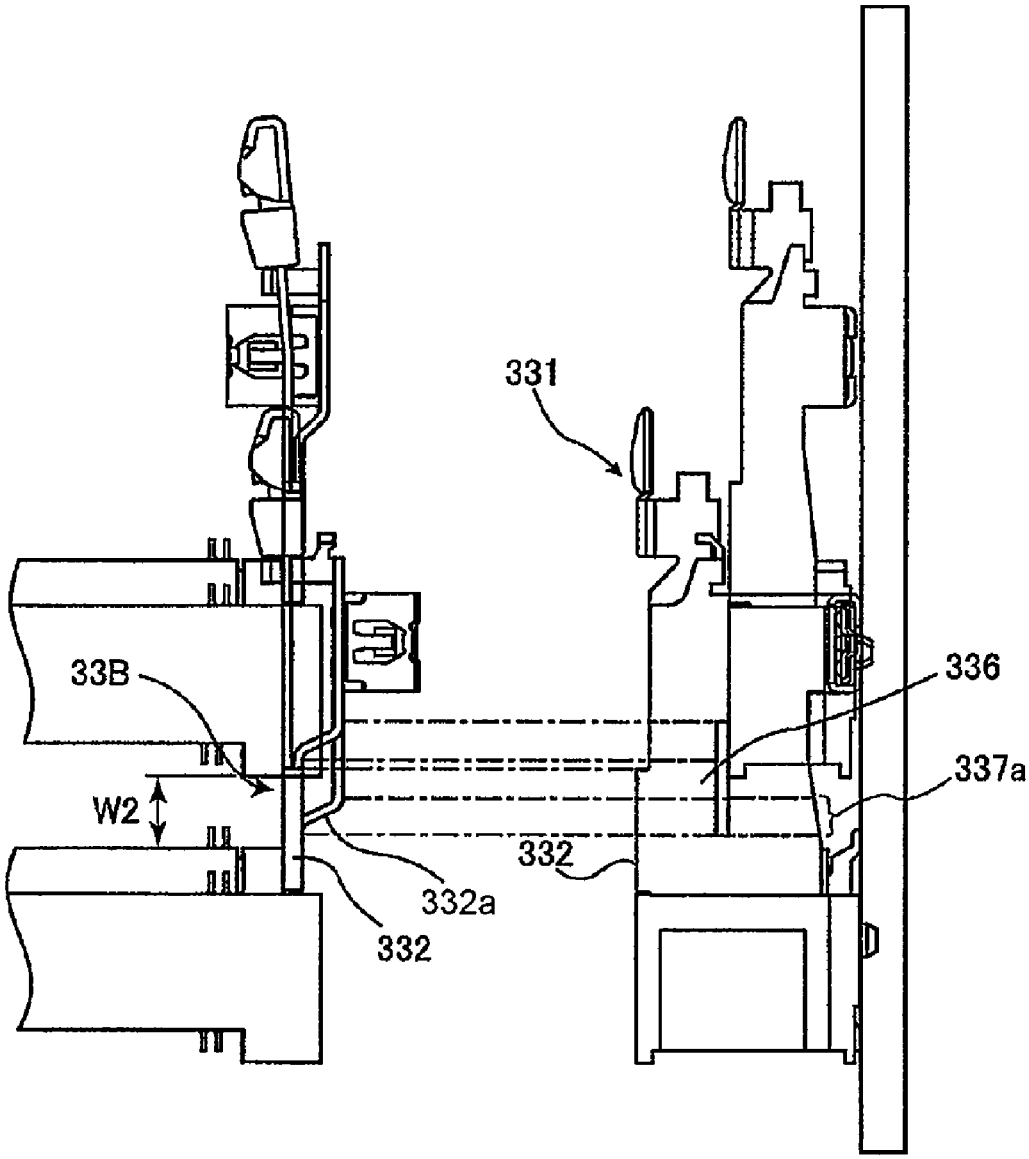
FIG. 8(*a*) is a schematic diagram showing a disposition distance between the lower card edge connector and the upper card edge connector.

As shown in FIGS. 5(*a*)-(*b*), the upper card edge connector 3 is mounted on a mother board M (FIG. 7(*b*)) which may be, for example, a printed circuit board, and a daughter board D2 (FIG. 7(*b*)) which may be, for example, a memory module, is attached to the upper card edge connector 3. The upper card edge connector 3 includes an insulating housing 31 which receives the daughter board D2 (FIG. 7(*b*)). The insulating housing 31 is provided with a daughter board receiving recess 311 that receives the daughter board D2 (FIG. 7(*b*)) from a front F thereof. A plurality of contacts 32 (only a few of the contacts 32 are illustrated in the figures) are disposed in upper and lower rows along a longitudinal direction of the daughter board receiving recess 311, i.e., in a lateral direction LR. Each of the contacts 32 includes a connection member 32*a* which is connected to the mother board M by, for example, soldering.

Figure 6:
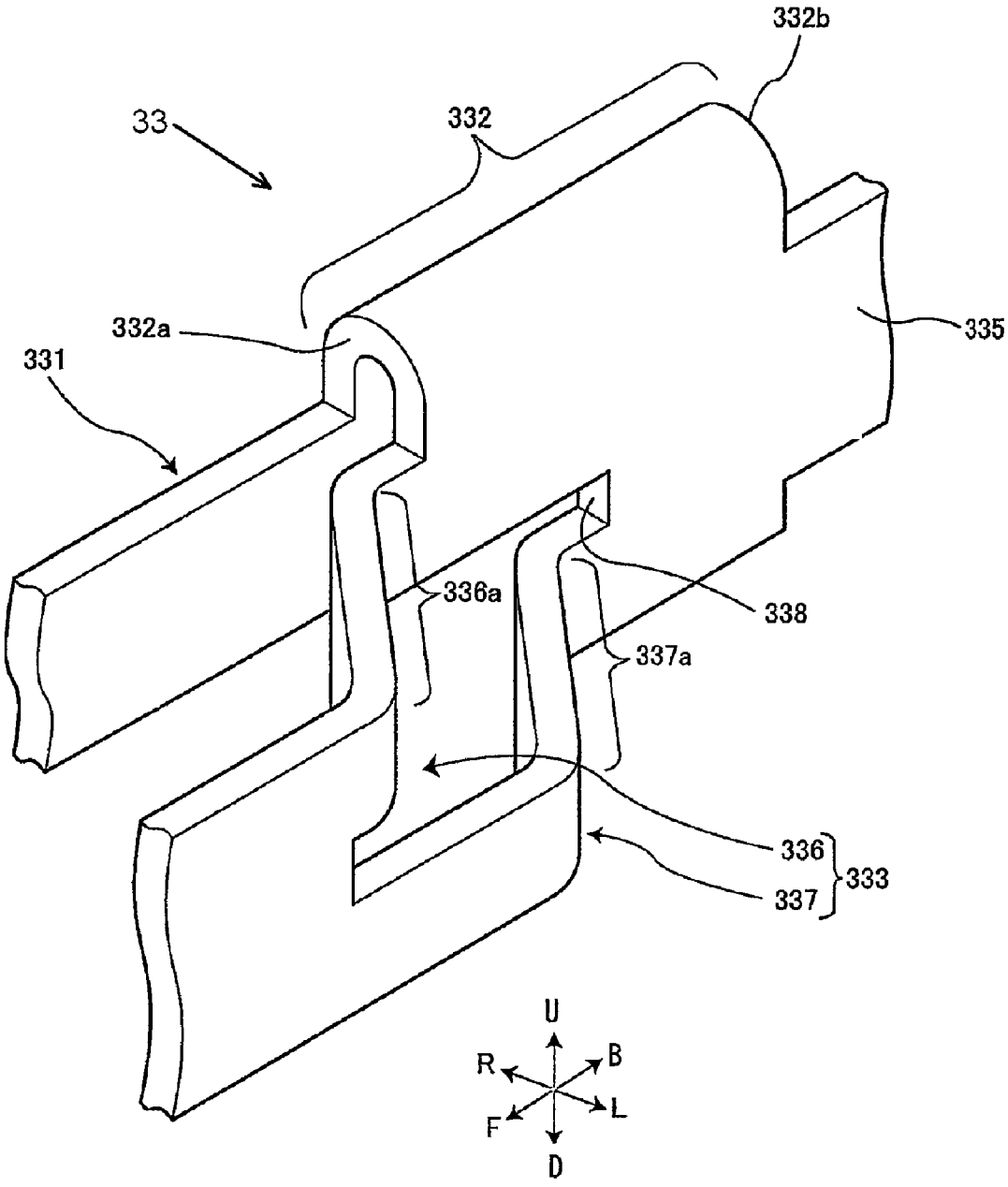
FIG. 6 is a front perspective view of a portion of a latch arm of the upper card edge connector shown in FIG. 5(*a*)

Latch arms 33 extend from the front F of the insulating housing 31 at both ends of the daughter board receiving recess 311, i.e., in the lateral direction LR. The latch arms 33 are formed symmetrically in the lateral direction LR. As shown in FIG. 6, each of the latch arms 33 includes a holding arm 331 for supporting the daughter board D2 (FIG. 7(*b*)). A support arm 333 supports the holding arm 331 and extends substantially parallel thereto. A folded portion 332, which is folded back from the holding arm 331, is provided between the holding arm 331 and the support arm 333. The folded portion 332 is folded back from an upper edge of a rear end of the holding arm 331 through about 180 degrees in a direction toward the latch arm 33 disposed on an opposite side thereof. The support arm 333 extends forward F from the folded portion 332.

A press-fit section 335 extends backward B from the support arm 333. The press-fit section 335 which is press-fitted into and fixed to the insulating housing 31 is provided on a rear side of the support arm 333. The holding arm 331 and the support arm 333 are bifurcated through the folded portion 332, and the press-fit section 335 located on a side of a root of the bifurcated portion is fixed to the insulating housing 31. The holding arm 331 is provided in a form of a cantilever spring in the insulating housing 31 using the press-fit section 335 and the folded portion 332 as a base. A tip end of the holding arm 331 displaces in the lateral direction LR by elastic deformation of the holding arm 331.

As shown in FIG. 5(*a*), the holding arm 331 is provided at a tip end with a first locking member 331*a* and a second locking member 331*b*. The first locking member 331*a* is configured to engage with a notch formed in an edge of the daughter board D2 (FIG. 7(*b*)) to prevent the daughter board D2 (FIG. 7(*b*)) from falling out of the insulating housing 31. The second locking member 331*b* holds the daughter board D2 (FIG. 7(*b*)) in a position substantially parallel to the mother board M (FIG. 7(*b*)) to maintain an electrical connection between the daughter board D2 (FIG. 7(*b*)) and the contacts 32.

As shown in FIG. 6, an opening 338 which is substantially thin and long in a longitudinal direction FB is formed in the support arm 333 of the latch arm 33 at a substantially central portion thereof in a vertical direction UD, for example, by stamping. The support arm 333 is divided into a first support section 336 and a second support section 337 by the opening 338. The opening 338 is formed at a location higher than a height of the insulating housing 11 of the lower card edge connector 1, as measured from a position of the mother board M (FIG. 7(*b*)). The first support section 336 is disposed at a position higher than a height of the lower card edge connector 1 (FIGS. 5(*a*)-(*b*)) as measured from the position of the mother board M (FIG. 7(*b*)). Thus, the first support section 336 and the lower card edge connector 1 do not interfere with each other. The folded portion 332 is connected to the upper edge rear side of the first support section 336. The first support section 336 and the second support section 337 are connected to each other on opposite sides of the opening 338. The opening 338 is formed closer to the insulating housing 31 than the front edge 332*a* of the folded portion 332 in the longitudinal direction FB along which the support arm 333 extends. The second support section 337 is connected to the first support section at a position closer to a rear edge 332*b* of the folded portion 332 in the longitudinal direction FB.

The first support section 336 is bent outward, i.e., leftward L in FIG. 6 toward the front F of a front edge 332*a* of the folded portion 332, and the first support section 336 is formed with an inclined portion 336*a* which is inclined diagonally outward toward the front F. The first support section 336 is again bent at a position in front F of the inclined portion 336*a* and extends forward substantially parallel to the holding arm 331. As shown in FIGS. 5(*a*)-(*b*), the first support section 336 is provided at a tip end with stoppers 333*c*, 333*b* which prevent the holding arm 331 from bending excessively. Since the holding arm 331 is disposed between the stoppers 333*c*, 333*b* provided on the support arm 333 fixed to the mother board M (FIG. 7(*a*)), the bending range is limited.

The second support section 337 is connected to the first support section 336 at a position on a side of the rear edge 332*b* of the folded portion 332. The second support section 337 is bent outward, i.e., leftward L at a position below the folded portion 332, i.e., at a position where the second support section 337 is superposed on the folded portion 332 in the longitudinal direction FB. The second support section 337 is formed with an inclined portion 337*a* which is inclined diagonally outward toward the front F. The second support section 337 is again bent at a position in front F of the inclined portion 337*a* and extends forward F substantially in parallel to the holding arm 331 and is connected to the first support section 336. As shown in FIGS. 5(*a*)-(*b*), the fixed section 334 projects from a lower edge of the tip end of the second support section 337. The fixed section 334 extends outward from a lower edge at a position where the second support section 337 is connected to the first support section 336.

A fixed section 334 is provided on a front lower portion of the support arm 333. A mother board attachment member 35 which may be formed, for example, by stamping and bending a metal plate, to have a substantially C-shaped cross section is mounted on the fixed section 334. The mother board attachment member 35 is connected to the mother board M (FIG. 7(*b*)) by soldering. When the mother board attachment member 35 is mounted, the mother board M (FIG. 7(*b*)) and an upper card edge connector 3 are reliably connected to each other through soldering. As shown in FIG. 5(*a*), the fixed sections 334 of the latch arms 33 are disposed at a distance from each other greater than a length of the lower card edge connector 1 in a lateral direction. Thus, the lower card edge connector 1 can be disposed to the front F of the inclined portion 337*a* of the second support section 337.

The latch arm 33 may be formed, for example, by stamping and forming a metal plate. In other words, the holding arm 331, the support arm 333, the folded portion 332 and the press-fit section 335 may be integrally formed in one piece.

As shown in FIGS. 7(*a*)-(*b*), when the daughter board D2 is to be attached to the upper card edge connector 3, the daughter board D2 is first inserted into the daughter board receiving recess 311 diagonally with respect to the mother board M. Then, the holding arm 331 is elastically deformed outward by manual operation and in this state, the daughter board D2 is rotated to an angle substantially parallel to the mother board M. Thereby, the daughter board D2 and the contacts 32 come into contact with each other, and the daughter board D2 and the mother board M are electrically connected to each other. Then, the holding arms 331 return inward, and sandwich and hold the daughter board D2 from both sides in the lateral direction LR by elastic forces. The first and second locking members 331*a*, 331*b* of the holding arm 331 are engaged with both side edges of the daughter board D2.

Figures 4A, 4B:
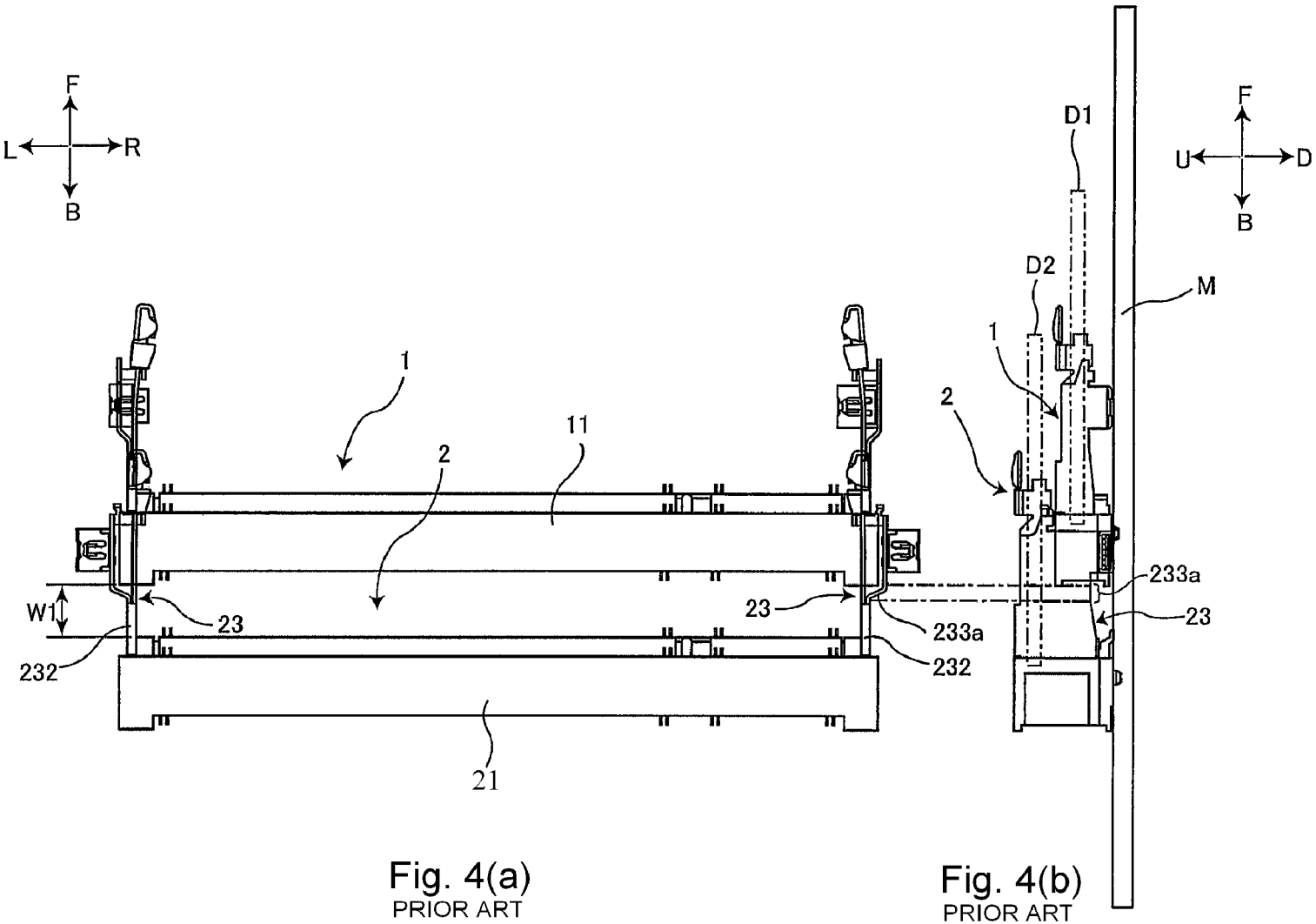
Fig. 4(b) PRIOR ART
Fig. 4(a) PRIOR ART
FIG. 4(*a*) is a plan view of the upper card edge connector and the lower card edge connector shown in FIG. 1(*a*) mounted on a mother board.

FIGS. 7(*a*)-(*b*) show the lower card edge connector 1 and the upper card edge connector 3 mounted to the surface of the mother board M by soldering. The lower card edge connector 1 is disposed between the daughter board D2 mounted on the upper card edge connector 3 and the mother board M and is disposed between the latch arms 33 of the upper card edge connector 3. More specifically, the insulating housing 11 of the lower card edge connector 1 is disposed in the front F of the inclined portion 337*a* formed on the latch arm 33 of the upper card edge connector 3. Thus, the insulating housing 11 of the lower card edge connector 1 is disposed on the back side B, i.e., close to the insulating housing 31 until the insulating housing 11 is arranged beside the folded portion 332. A disposition distance W2 between the lower card edge connector 1 and the upper card edge connector 3 is narrower than the disposition distance W1 between the lower card edge connector 1 and the upper card edge connector 2 shown in FIG. 4. Therefore, an area occupied by the lower card edge connector 1, the upper card edge connector 3, the daughter board D2, and the daughter board D1 on the mother board M is reduced as compared with the occupied area shown in FIG. 4. The first support section 336 is bent at a position forward to the front edge 332*a* (FIG. 6) of the folded portion 332, and the length of the folded portion 332 is maintained at the same length as that of the folded portion 232 of the upper card edge connector 2 shown in FIG. 4. Thus, the rigidity of the holding arm 331 is maintained at the same level as that of the holding arm 231 of the upper card edge connector 2 shown in FIG. 4. The folded portion 332 has the same strength as that of the upper card edge connector 2 shown in FIG. 4.

The foregoing illustrates some of the possibilities for practicing the invention. Many other embodiments are possible within the scope and spirit of the invention. In this embodiment, the example of the upper card edge connector 3 is used in conjunction with the lower card edge connector 1, but the invention is not limited thereto. For example, the invention may be applied to one of three or more card edge connectors mounted such that three or more daughter boards are superposed, except the lowermost card edge connector. Additionally, although the example of the memory module is explained as the daughter board D2 in the embodiment, the card edge connector of the invention is not limited thereto, and the invention may be applied to a card edge connector of a daughter board on which an integrated circuit of expansion function is mounted. It is, therefore, intended that the foregoing description be regarded as illustrative rather than limiting, and that the scope of the invention is given by the appended claims together with their full range of equivalents.

What is claimed is:

1. A card edge connector for electrically connecting a mother board with a daughter board, the card edge connector comprising:

an upper card edge connector with an insulating housing provided with a daughter board receiving recess;

latch arms extending from the insulating housing at both ends of the daughter board receiving recess, each of the latch arms having a holding arm for supporting the daughter board and extending substantially parallel to a support arm, the holding arm being connected to the support arm by a folded portion; and at least a portion of the support arm being divided by an opening into a first support section having two ends and a second support section having two ends; wherein both ends of the first and second support sections are connected to each other on opposite sides of the opening, the first support section and the second support section each having an inclined portion extending diagonally outward and away from the holding arm.

2. The card edge connector of claim 1, wherein the folded portion is folded about 180 degrees.

3. The card edge connector of claim 1, wherein each of the latch arms are arranged such that holding arm is positioned closer to the daughter board receiving recess than the support arm.

4. The card edge connector of claim 1, wherein the support arm includes a mother board attachment member for fixing the latch arm to the mother board.

5. The card edge connector of claim 1, wherein the inclined portion of the second support section is arranged closer to the housing than the inclined portion of the first support section.

6. The card edge connector of claim 1, wherein each of the latch arms is formed from a single metal plate.

7. The card edge connector of claim 1, further comprising a lower card edge connector disposed between the latch arms of the upper card edge connector.

8. The card edge connector of claim 1, wherein the holding arm includes a first locking member for engaging with a notch in the daughter board.

9. The card edge connector of claim 8, wherein the holding arm includes a second locking member for supporting the daughter board.

* * * * *